US006830157B2

(12) United States Patent
Robertson et al.

(10) Patent No.: US 6,830,157 B2
(45) Date of Patent: Dec. 14, 2004

(54) PIE PUSHER MERCHANDISING DISPLAY DEVICE

(75) Inventors: James David Robertson, Atlanta, GA (US); Garrison Brooks, Marietta, GA (US)

(73) Assignee: Display Industries, LLC., Norcross, GA (US)

( * ) Notice: Subject to any disclaimer, the term of this patent is extended or adjusted under 35 U.S.C. 154(b) by 58 days.

(21) Appl. No.: 10/306,478

(22) Filed: Nov. 27, 2002

(65) Prior Publication Data

US 2004/0099620 A1 May 27, 2004

(51) Int. Cl.[7] ..... A47F 1/04
(52) U.S. Cl. ..... 211/59.3
(58) Field of Search ..... 211/59.3, 74, 59.2, 211/169; 312/71

(56) References Cited

U.S. PATENT DOCUMENTS

| | | | | | |
|---|---|---|---|---|---|
| 463,256 | A | * | 11/1891 | Side | 312/71 |
| 2,824,666 | A | * | 2/1958 | Hausladen | 312/71 |
| 2,954,128 | A | * | 9/1960 | Murray | 211/59.3 |
| 3,110,402 | A | * | 11/1963 | Mogulescu | 211/59.3 |
| 3,161,295 | A | * | 12/1964 | Chesley | 211/59.3 |
| 3,224,822 | A | * | 12/1965 | Kirby | 312/71 |
| 3,308,961 | A | * | 3/1967 | Chesley | 211/59.3 |
| 3,342,536 | A | * | 9/1967 | Cohen | 312/71 |
| 3,679,096 | A | * | 7/1972 | Musser | 221/56 |
| 4,730,741 | A | | 3/1988 | Jackle, III et al. | 211/59.3 |
| 4,887,737 | A | * | 12/1989 | Adenau | 312/71 |
| 4,901,869 | A | | 2/1990 | Hawkinson et al. | 211/59.3 |
| 5,131,563 | A | * | 7/1992 | Yablans | 312/71 |
| 5,449,076 | A | * | 9/1995 | Van Noord | 211/59.3 |
| 5,450,969 | A | | 9/1995 | Johnson et al. | 211/59.3 |
| 5,562,217 | A | | 10/1996 | Salveson et al. | 211/59.3 |
| 5,605,237 | A | * | 2/1997 | Richardson et al. | 211/59.3 |
| 5,634,564 | A | | 6/1997 | Spamer et al. | 211/59.3 |
| 5,685,664 | A | | 11/1997 | Parham et al. | 403/393 |
| 5,964,373 | A | * | 10/1999 | Hucknall | 221/6 |
| 6,015,051 | A | | 1/2000 | Battaglia | 211/59.3 |
| 6,082,558 | A | | 7/2000 | Battaglia | 211/59.3 |
| 6,129,218 | A | | 10/2000 | Henry et al. | 211/59.3 |
| 6,193,337 | B1 | * | 2/2001 | Roeker et al. | 312/60 |
| 6,378,727 | B1 | * | 4/2002 | Dupuis et al. | 211/59.3 |
| 6,409,027 | B1 | * | 6/2002 | Chang et al. | 211/59.3 |
| 6,464,089 | B1 | * | 10/2002 | Rankin, VI | 211/59.3 |
| 6,536,609 | B2 | * | 3/2003 | Lake | 211/59.3 |
| 6,655,536 | B2 | * | 12/2003 | Jo et al. | 211/59.3 |
| 2001/0035383 | A1 | * | 11/2001 | Burke | 211/59.3 |
| 2002/0108916 | A1 | * | 8/2002 | Nickerson | 211/59.3 |
| 2003/0057167 | A1 | * | 3/2003 | Johnson et al. | 211/59.3 |
| 2003/0085187 | A1 | * | 5/2003 | Johnson et al. | 211/59.3 |
| 2004/0000528 | A1 | * | 1/2004 | Nagel | 211/59.3 |

* cited by examiner

*Primary Examiner*—Carl D. Friedman
*Assistant Examiner*—Jennifer E. Novosad
(74) *Attorney, Agent, or Firm*—John L. James

(57) ABSTRACT

A merchandising display track device is adapted to merchandise pies so that pies can be dispensed one at a time with the oldest pie dispensed first. The preferred embodiment of the device comprises a base member having a front end portion, first and second upstanding sidewalls connected to the base member forming a U-shaped structure having a front end portion, a rail connected to the base member between the sidewalls, and a pusher mechanism adapted to ride on the rail and push the articles toward the front end portion of the tubular housing. The front end portion of the base member extends forward more than the front end portion of the U-shaped structure to hold an article for dispensing articles one at a time.

8 Claims, 16 Drawing Sheets

PIE PUSHER MERCHANDISING DISPLAY DEVICE

TECHNICAL FIELD OF THE INVENTION

This invention relates to a display device useful in merchandising articles, and, more particularly, to a shelf device having a pusher member for pushing articles forward on the shelf.

BACKGROUND OF THE INVENTION

Articles for sale are more appealing when fresh articles are displayed in a neat and orderly manner. Merchandising display shelves are used to enhance appeal by promoting order. Some articles can be arranged neatly in stacks on the shelves, while other articles can be arranged in orderly rows. Unfortunately shoppers have a tendency to topple neat stacks and dishevel orderly rows thereby requiring an attendant to restore order to the articles which is not only time consuming but costly as well. Also, it often places the attendant in a shopper's path making shopping less efficient. It is desirable to have a merchandising device that helps maintain the articles in an attractive arrangement.

In refrigerator and freezer units in supermarkets and other stores, articles, such as packages of frozen food, such as pies and pie shells for example, are often stacked on wire shelves. It does not take very long for the articles to become disheveled as a shopper removes articles from the rear or as close to the rear as is reachable in an effort to obtain the coldest, freshest or most frozen article available. Articles at the rear of the shelf are difficult to reach, and almost impossible to reach without experiencing discomfort from the cold or damp clothing as a result of the effort. There are track devices for dividing a wide shelf into narrower channels which help keeps articles in orderly rows. Many of these are bulky and unsuitable for use with frozen vegetables, pies, pie shells and other food articles. Also, many shelf devices depend on gravity feed to advance articles forward for removal.

There are pusher devices that push articles on a shelf forward for easy removal, but many of these devices lack ventilation which is required to keep frozen articles frozen. In a refrigerator there must be adequate ventilation to keep fresh foods fresh and frozen foods frozen. Some devices only push the articles forward without addressing dividing the articles into rows. Pusher devices disclosed in U.S. Pat. Nos. 5,562,217 and 5,634,564 are specifically designed to push beverage bottles forward but are not specifically designed for fresh or frozen articles. Accordingly, it will be appreciated that it would be highly desirable to have a pusher device that pushes a row of fresh or frozen articles forward while providing ventilation to keep the articles fresh or frozen.

SUMMARY OF THE INVENTION

The present invention is directed to overcoming one or more of the problems set forth above. Briefly summarized, according to one aspect of the invention, a merchandising display shelf track device is adapted to receive articles for sliding movement therealong for dispensing the articles one at a time. The device comprises a base member having a front end portion, upstanding sidewalls connected to the base member forming a U-shaped structure with a front end portion, a rail connected to the base member between the sidewalls, and a pusher mechanism adapted to ride on the rail and push the articles toward the front end portion of the tubular housing.

Spacer panels attached to the base member adjacent the sidewalls provide a pathway for the circulation of air. The front end portion of the base member extends forward more than the front end portion of the U-shaped structure so that the sidewalls do not obscure the pie or other merchandise. An upturned portion of the front end portion facilitates displaying a lead article or a stack of lead articles and positions the top lead article for easy removal. As the bottom article is removed, the pusher mechanism pushes the next stack of articles forward. The upturned portion of the front end portion acts as a stopper panel to retain the articles in the device until removed by a consumer.

According to another aspect of the invention, a merchandising display shelf track device comprises front and rear members, a bottom rail connected to the front and rear members that extends longitudinally between the front and rear members, a first top rail connected to the front member and positioned at a higher elevation than the bottom rail with the first top rail extending longitudinally between the front and rear members, and a second top rail connected to the front member and positioned at a higher elevation than the bottom rail with the second top rail extending longitudinally between the front and rear members. The first and second rails are spaced from one another and the top and bottom rails form a cradle adapted to receive the articles.

This cradle is formed of wire or plastic to support articles such as pies or pie shells on edge in an upright position. A pusher mechanism connected to the bottom rail ensures that articles are pushed forward for easy dispensing. A front panel attaches to the front member to provide product identification.

A tube positioned about the top and bottom rails and fastened to the bottom rail extends longitudinally so that a portion of the top and bottom rails extend longitudinally inside the tube. The pusher mechanism is located inside the tube and fastened to the bottom rail.

According to yet another aspect of the invention, a merchandising display shelf track device adapted to receive articles for sliding movement therealong comprises a base, a bottom rail connected to the base extending longitudinally along the base, and a tubular housing connected to the base and positioned about the bottom rail so that a portion of the bottom rail extends longitudinally inside the tubular housing. A pusher mechanism connected to the bottom rail pushes article forward for dispensing. A front panel attached to the front member acts as a stopper to prevent articles from being pushed off the device.

The tubular housing easily accommodates circular articles such as pies and pie shells with the articles standing on edge. A pusher mechanism connected to the bottom rail pushes the articles forward for dispensing one at a time. A cover panel covers a coil spring that provides the force for pushing the articles forward. The cover panel shield fingers from the spring while restocking the articles on the shelf.

The door panel closes to keep articles, such as frozen pies or pie shells, frozen while allowing access to remove one article at a time. A square or rectangular tube accommodates boxes of pies or pie shells with the shells sitting on their bottoms rather than their edges which allows a full view of the front of the container. The door panel allows pies to sit flat and be removed one at a time by naturally lifting and pulling forward.

According to a further aspect of the invention, a merchandising display shelf track device adapted to receive articles for sliding movement therealong comprises an elongated tubular housing having an interior sidewall and a front end portion, a rail connected to the interior sidewall, and a pusher mechanism adapted to ride on the rail and push the articles toward the front end portion of the tubular housing. The tubular housing has four interior sidewalls and the rail is connected to any one of the sidewalls. A door panel is connected to the housing and is pivotable between open and closed positions. At the closed position the door panel covers the front end portion to block access to the interior of the housing so that cold air stays inside the housing. At the open position the door panel allows access to the interior through the front end portion so that articles can be removed. The door panel is preferably hingedly connected along its top to pivot vertically between the open and closed positions.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
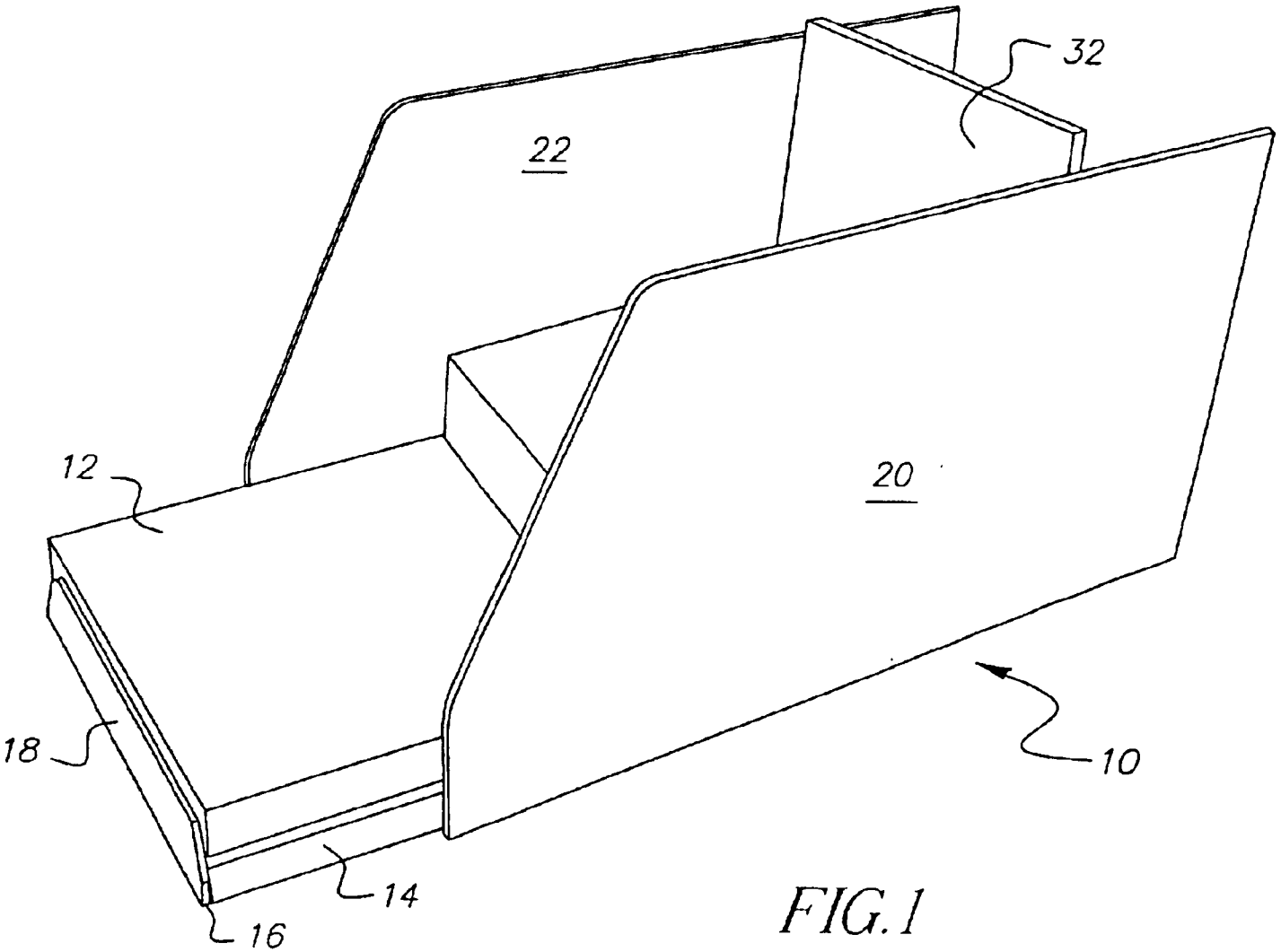
FIG. 1 is a side perspective view of a preferred embodiment of a pie pusher merchandising display track device according to the present invention.
Figure 2:
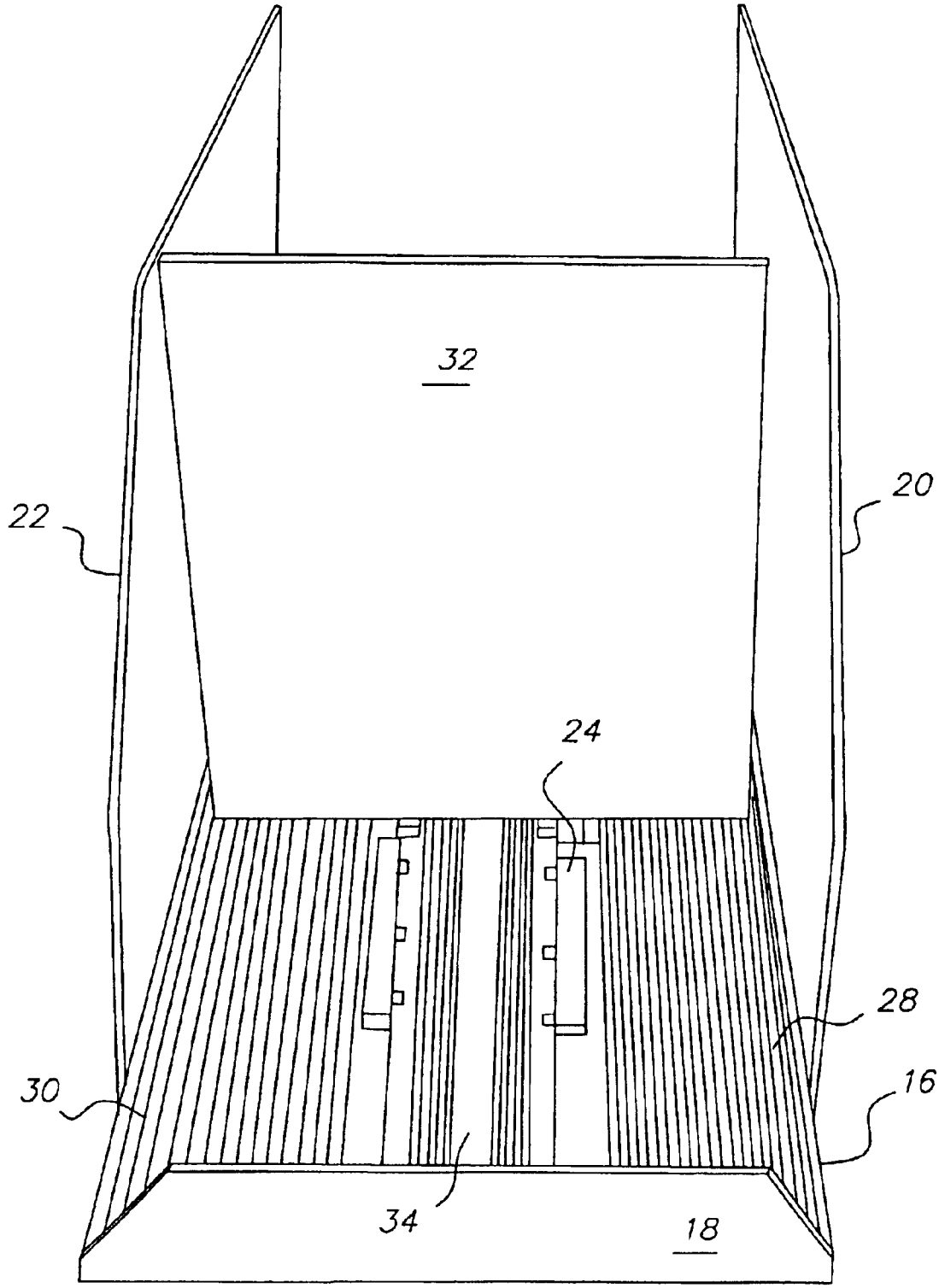
FIG. 2 is a front perspective view of the pie pusher of FIG. 1.
Figure 3:
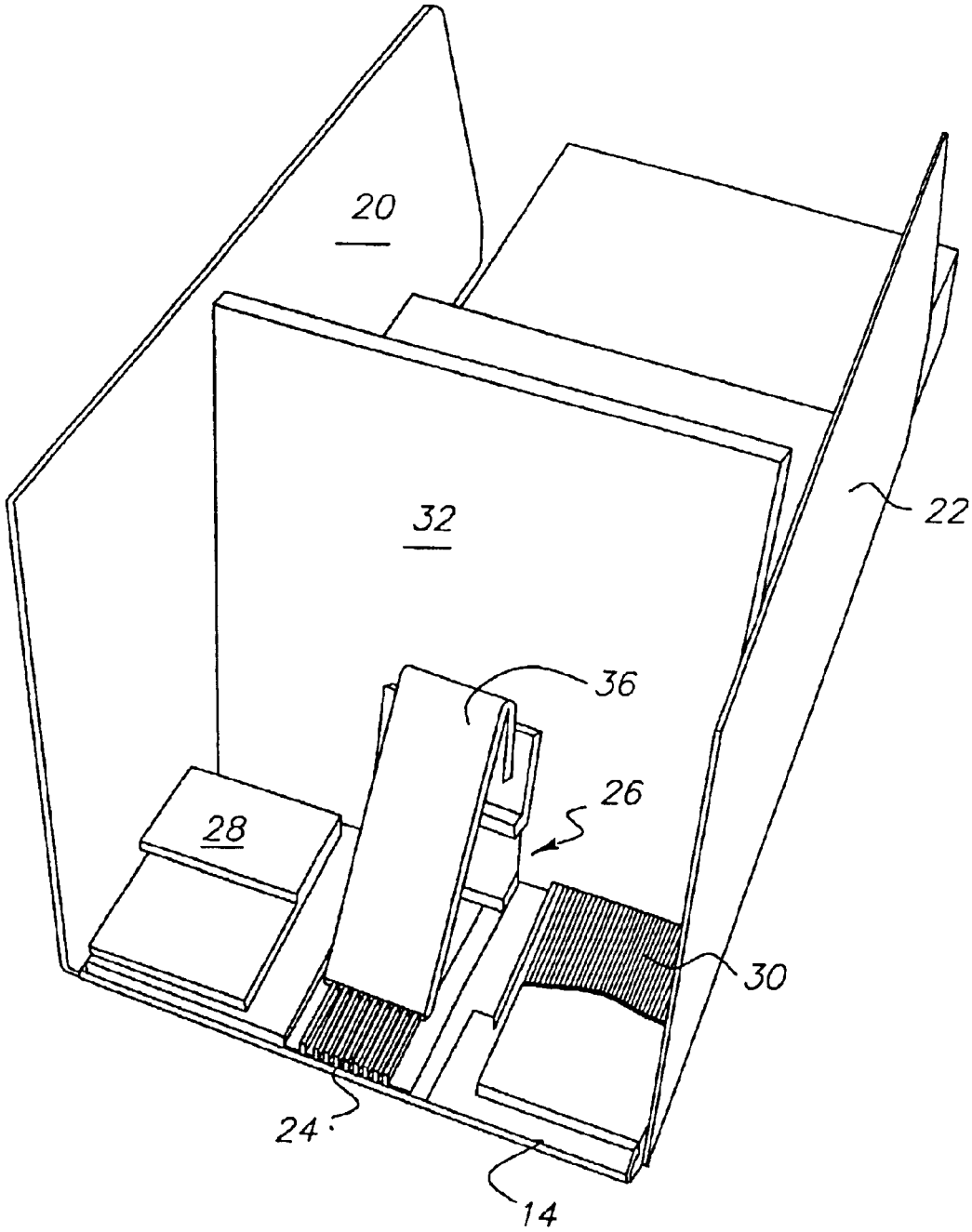
FIG. 3 top rear perspective view of the pie pusher of FIG. 1.

Referring to FIGS. 1–3, a merchandising display shelf track device 10 is adapted to receive articles, such as pies 12 for example, for sliding movement therealong. Device 10 has a base member 14 preferably constructed of plastic. Base member 14 has a front end portion 16 and a stopper panel 18 upstanding from front end portion 16 of base member 14. First and second upstanding sidewalls 20, 22 are connected to base member 14 forming a U-shaped housing structure having a front end portion. The front end portion of base member 14 extends forward a distance greater than the front end portion of the U-shaped housing structure. By this construction, the sides of an article sitting on base member 14 are visible for easy product identification and increased visual appeal of the article.

A rail 24 is connected to base member 14 between the sidewalls 20, 22. Because rail 24 is attached to base member 14, it lies above base member 14 creating a space for air flow between the bottom of the articles 12 and base member 14. A pusher mechanism 26 is adapted to ride on rail 24 and push the articles toward the front end portion 16 of the pie pusher device 10. Pusher mechanisms are well known in the art. A pusher mechanism and rail are more fully described in co-pending application Ser. No. 09/964,090, filed Sep. 26, 2001, the disclosure of which is incorporated herein by reference.

To keep the articles 12 from leaning to one side or the other, first and second spacer panels 28, 30 are attached to base member 14 adjacent a respective one of the sidewalls 20, 22. Spacer panels 28, 30 keep the articles 12 level while allowing for the free circulation of air. The panels 28, 30 may each have a plurality of parallel ribs that create air passageways, or may have a number of slots or other openings for air to flow through. Each panel may be formed of a single piece of material, or may have a solid base topped with a rib-bearing cover member.

A pusher panel 32 is connected to the pusher mechanism 26 and, preferably, slidably moves along spacer panels 28, 30. Ideally, pusher panel 32 is the same size as the article 12 to provide maximum support without danger of damage to the article or its packaging. If, for example, the panel has too small a surface area, it could damage a fragile article such as a pie shell, even when the shell is packaged in a box for display. On the other hand, too large a surface area could needlessly waste precious refrigerator shelf space.

Pusher mechanism 26 includes a coil spring 34 that provides the motive force for pushing articles forward as it recoils. A cover panel 36 attached to the rear of pusher panel 32 covers coil spring 34. With the coiled portion of coil spring 34 covered, a person stacking articles in the device would not expose fingers or clothing to the coiled portion of the spring.

Figure 4:
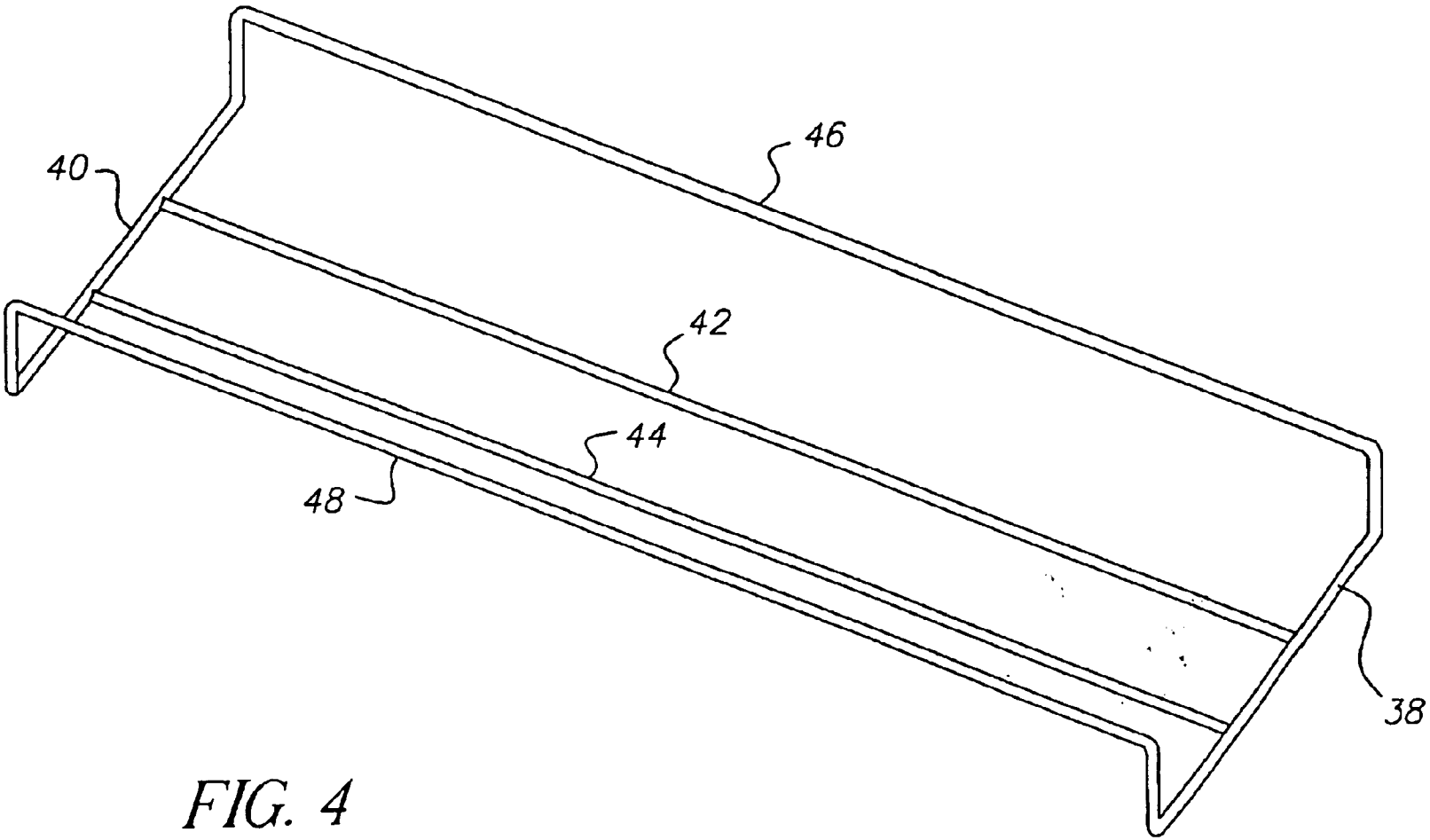
FIG. 4 is a perspective view of another preferred embodiment of a merchandising display track device according to the present invention.
Figure 5:
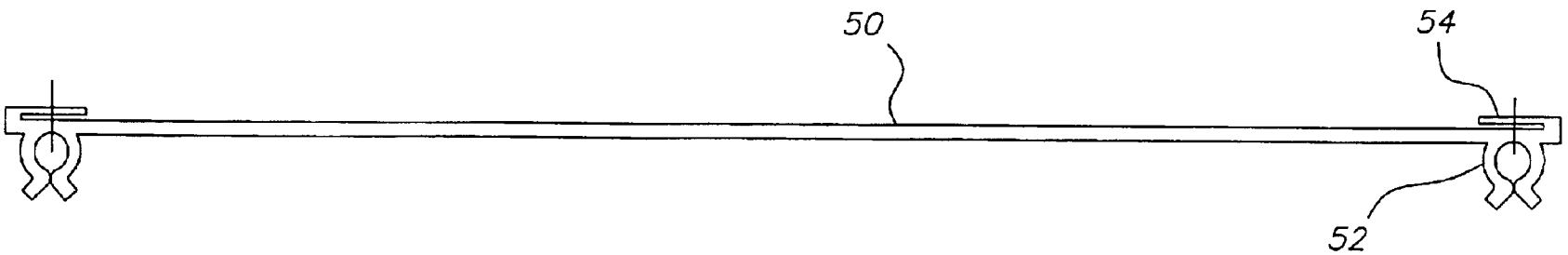
FIG. 5 is an attachment for the front of the device of FIG. 4.

Referring now FIGS. 4–5, a merchandising display shelf track device is preferably constructed of wire formed as a basket adapted to receive articles, such as pies. The device has U-shaped front and rear members 38, 40 and at least one bottom rail, but preferably two bottom rails 42, 44 connected to both front and rear members 38, 40. Bottom rails 42, 44 extend longitudinally between the front and rear members 38, 40.

A first top rail 46 is connected to front member 38 and rear member 40 and is positioned at a higher elevation than bottom rail 42. A first top rail 46 extends longitudinally between the front and rear members 38, 40. A second top rail 48 is connected to the front and rear members 38, 40 and is positioned at a higher elevation than bottom rail 44. The second top rail 48 extends longitudinally between the front and rear members 38, 40. The first and second top rails are spaced from one another a greater distance than the bottom rails are spaced from one another so that the top and bottom rails form a cradle to receive the articles.

A front panel 50 has one or more clips 52 on each end thereof for attaching panel 50 to the front member 38. Front panel 50 preferably has a front surface suitable for attaching or imprinting product identification information. One or more pairs of secondary clips 54 may be used to hold a product label against the front panel 50.

Figure 6:
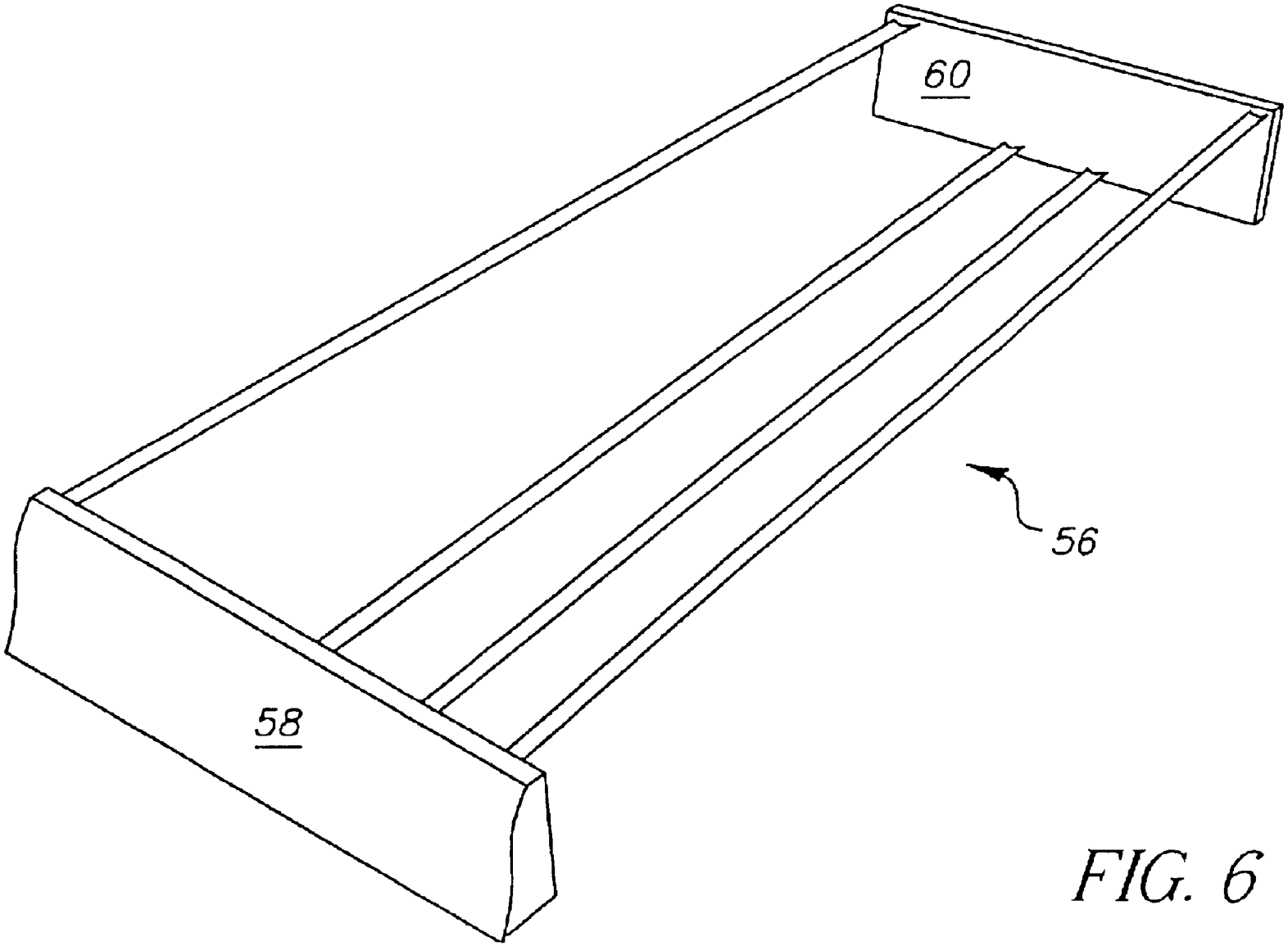
FIG. 6 is a perspective view of a preferred embodiment of a merchandising display track device for pies according to the present invention.

Referring to FIG. 6, a wire frame 56, similar to the wire frame of FIG. 4, is covered or coated with plastic, rubber or other coating material to increase aesthetic appeal. Front and rear panels 58, 60 may each be imprinted with product identification or may have product labeling affixed thereto.

Figure 7:
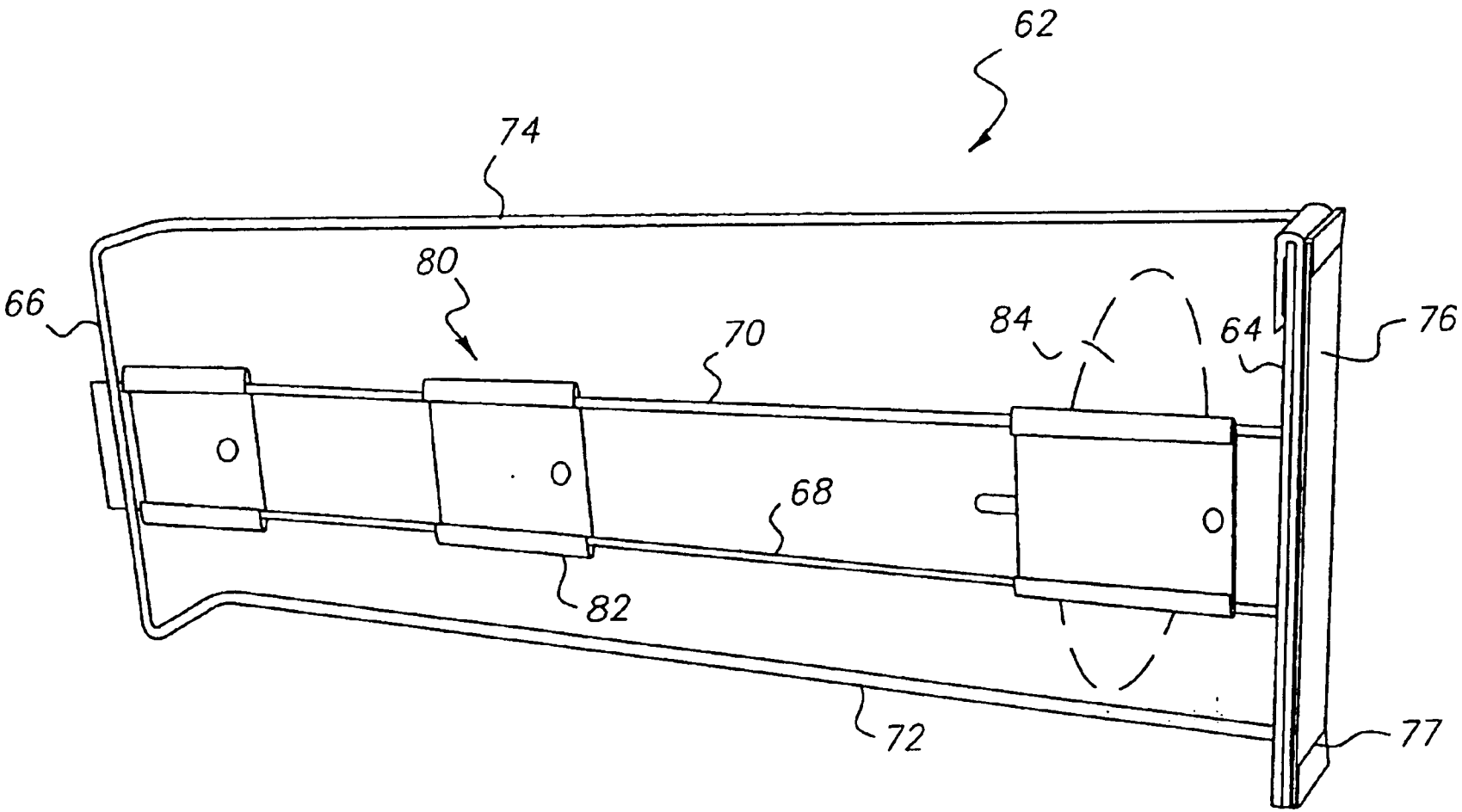
FIG. 7 is a bottom perspective view of a pie pusher merchandising display track device, similar to FIG. 4, but illustrating another preferred embodiment according to the present invention.
Figure 8:
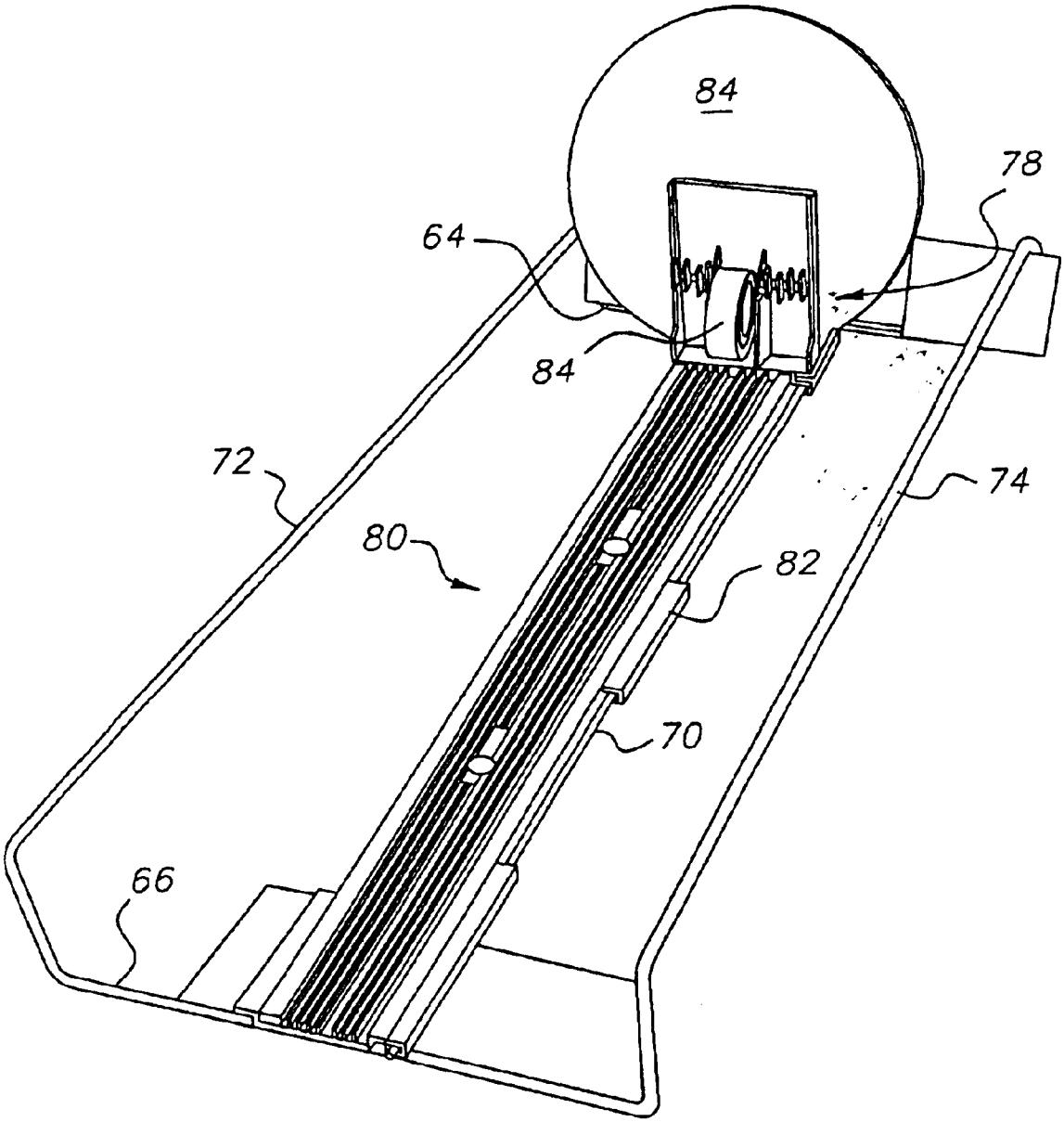
FIG. 8 is a top perspective of the pie pusher of FIG. 7.
Figure 9:
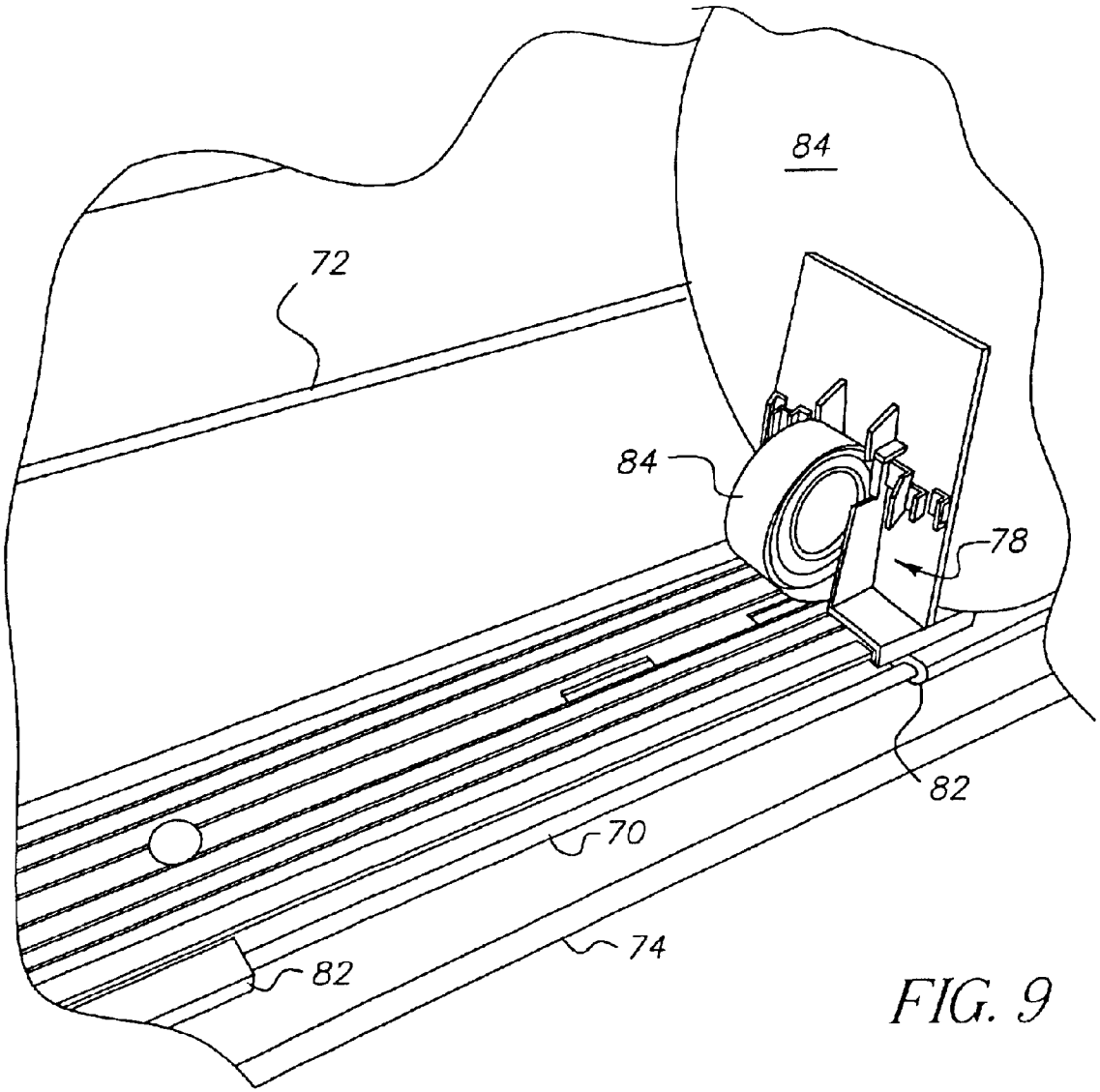
FIG. 9 is a rear perspective view of the pie pusher of FIG. 7.

Referring to FIGS. 7–9, a pie pusher 62 has a front member 64, a rear member 66, and bottom rails 68, 70 connected to the front and rear members 64, 66 and extending longitudinally between the front and rear members 64, 66. A first top rail 72 is connected to front member 64 and rear member 66, and is positioned at a higher elevation than the bottom rails 68, 70. First top rail 72 extends longitudinally between the front and rear members 64, 66. A second top rail 74 is connected to front member 64 and rear member 66, and is positioned at a higher elevation than the bottom rails 68, 70. Second top rail 74 also extends longitudinally between the front and rear members 64, 66. The first and second top rails are spaced from one another, and the first and second bottom rails are spaced from one another. The space between the top rails is greater than the space between the bottom rails so that the top and bottom rails form a cradle adapted to receive and hold pies, pie shells and other articles having a circular periphery to rest in the cradle.

A front panel 76 is attached to front member 64, preferably by clips or the like. Secondary clips 78 on front panel 76 may be used to affix product identification, or product labeling may be applied directly to front panel 76, preferably with an adhesive or the like.

A pusher mechanism 78 is coupled to the bottom rails 68, 70 via a central rail 80. Central rail 80 preferably has a length equal to or less than the length of bottom rails 68, 70. If central rail 80 is longer than the bottom rails, it exceeds the length of the frame and may not fit the refrigerator shelf for which the frame is constructed. If central rail 80 is too short, it is not long enough to accommodate the number of articles for which the frame is constructed. Central rail 80 is therefore preferably shorter than the bottom rails by not more than the thickness of one article.

Central rail 80 has a central body portion that is preferably narrower that the space between the bottom rails 68, 70, but it can have a central body portion that is equal in width to bottom rail spacing or even greater than the bottom rail spacing. The narrower width is preferred so that pusher mechanism 78 can be kept narrower than the bottom rail spacing to thereby maintain the benefit of the cradle structure. The narrow width allows central rail 80 to be kept low near the level of the bottom rails where bottom rails 68, 70 and central rail 80 cooperate to effectively form a single rail so that the cradle structure is maintained.

Central rail 80 has a number of clips 82 attached to the central body. The clips 82 snap onto the bottom rails 68, 70 to anchor the central rail. The pusher mechanism 78 with its coil spring 84 ride on central rail 80. A pusher panel 84 is connected to the pusher mechanism 78 and, preferably, slidably moves along central rail 80. Ideally, pusher panel 84 is the same size as the article to provide maximum support without danger of damage to the article or its packaging. If the panel has too small a surface area, damage could result to a fragile article such as a pie shell, even when the shell is packaged in a box for display. On the other hand, too large a surface area could needlessly waste precious refrigerator shelf space.

Figures 10, 13:
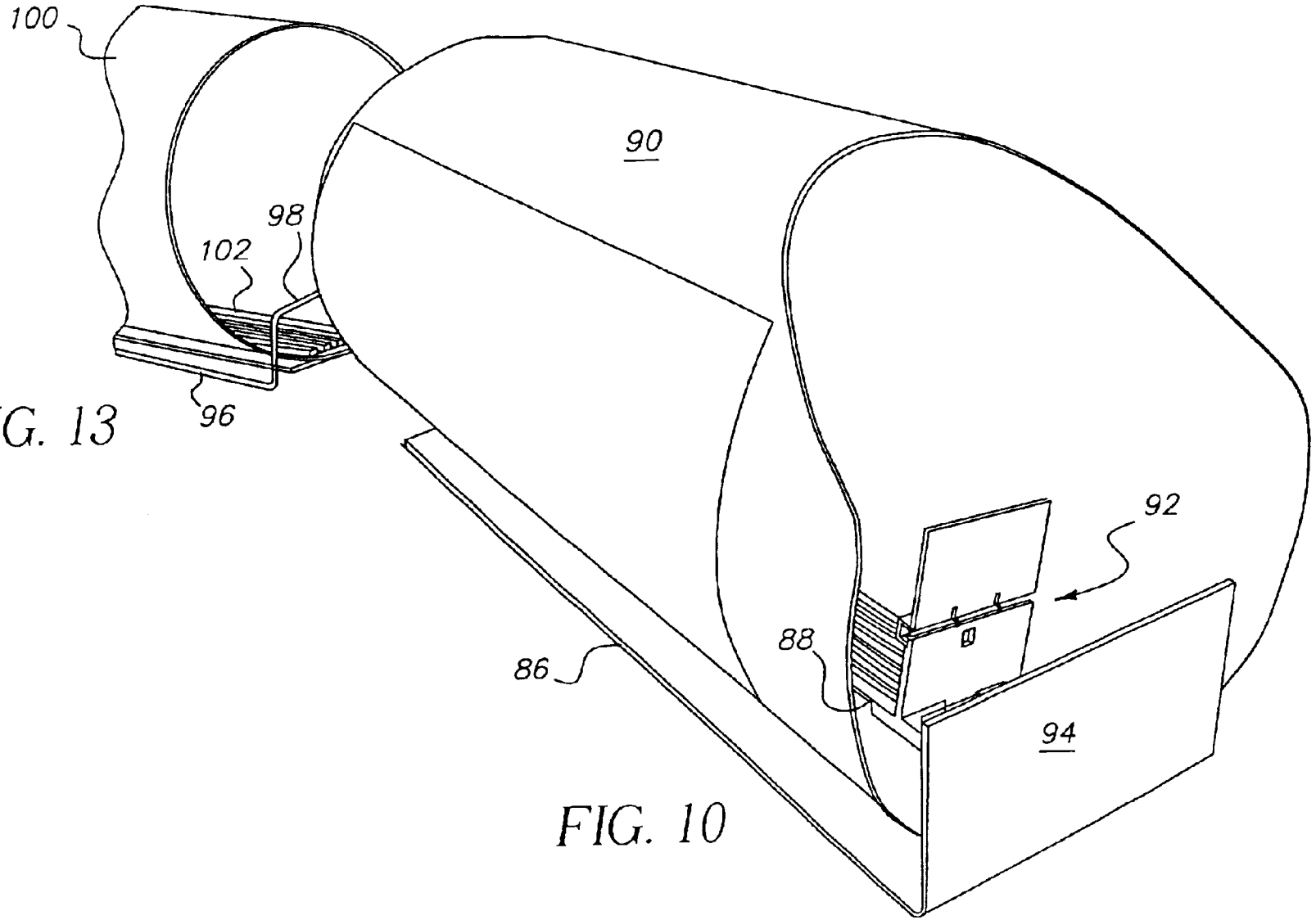
FIG. 10 is top perspective view of another preferred embodiment of a pie pusher merchandising display track device according to the present invention.
FIG. 13 is top perspective view of another preferred embodiment of a pie pusher merchandising display track device incorporating a wire frame and tube according to the present invention.
Figure 11:
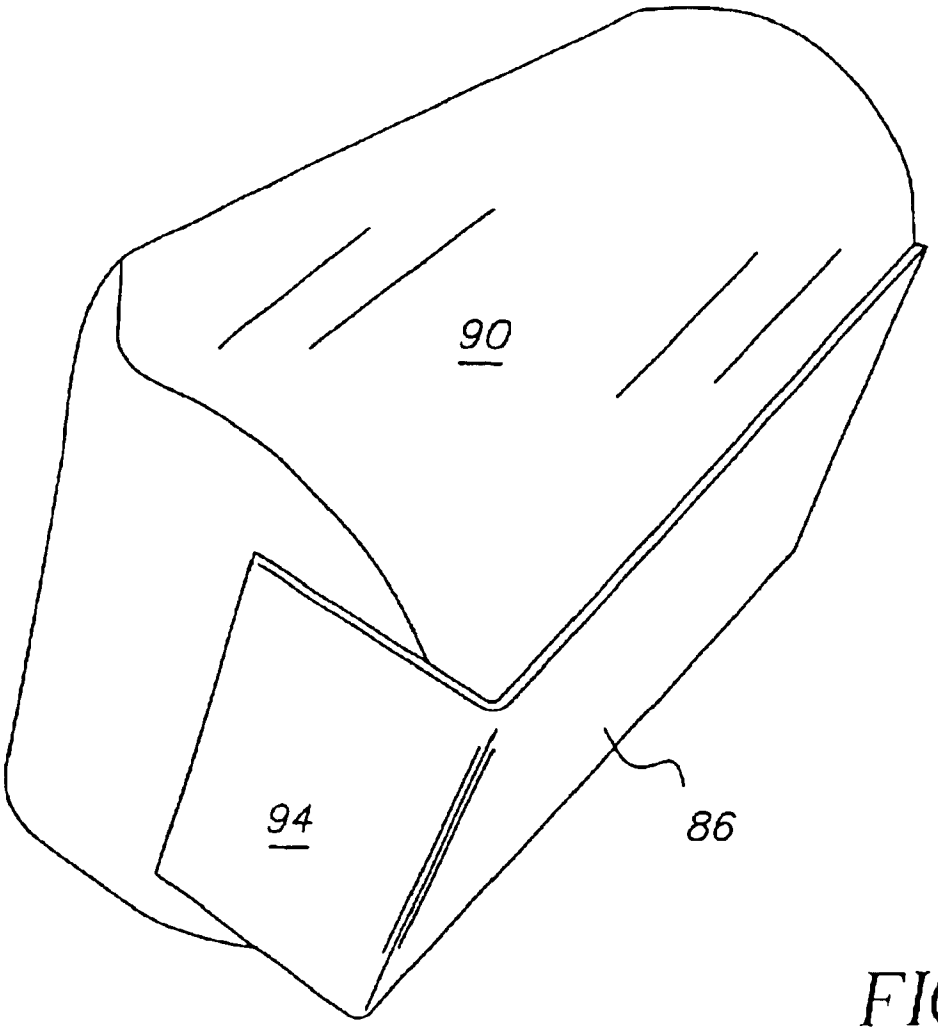
FIG. 11 is bottom perspective view of the pie pusher of FIG. 10.
Figure 12:
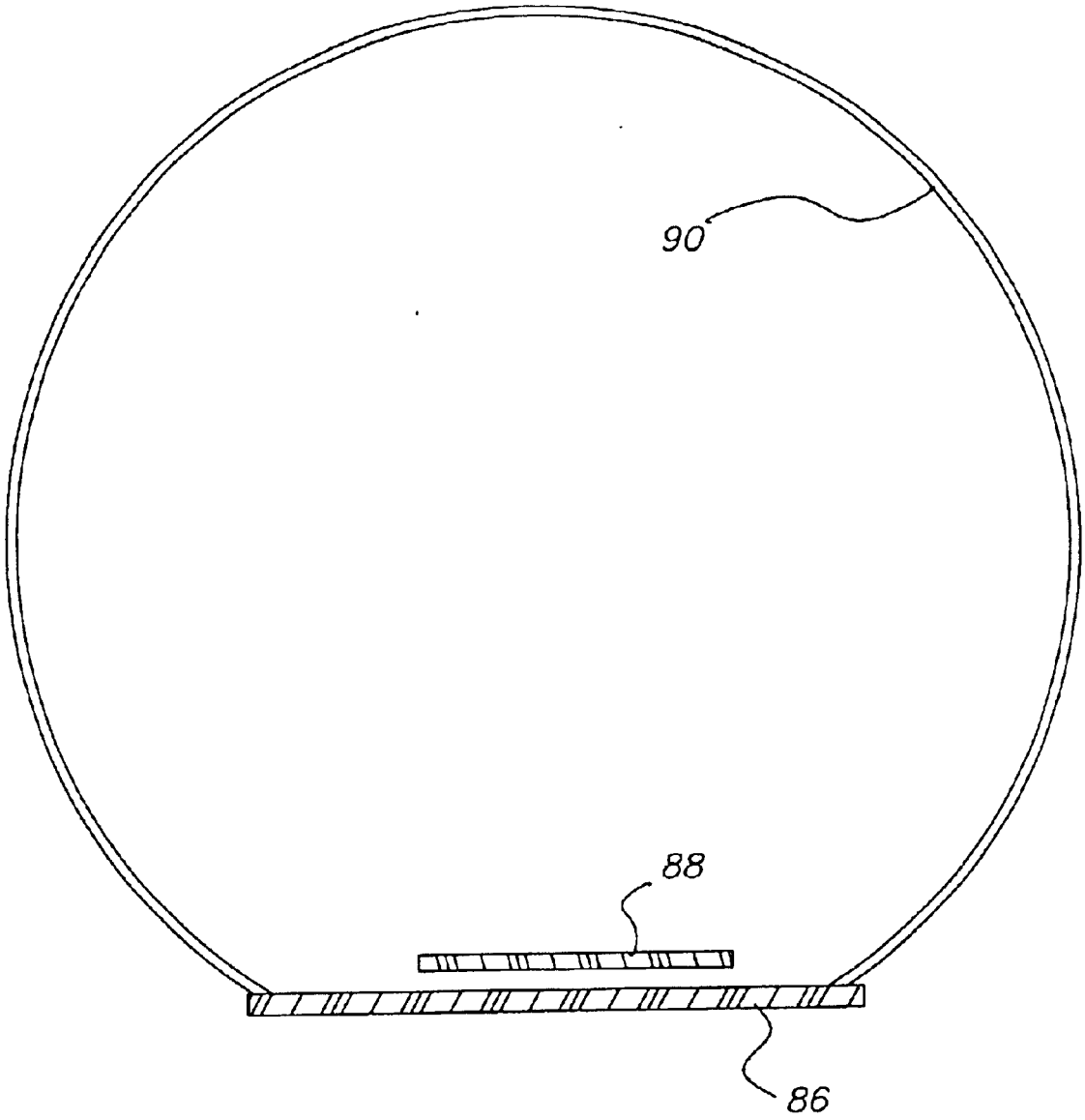
FIG. 12 is a diagrammatic sectional view of the pie pusher of FIG. 11 taken along the midsection of the device.

Referring to FIGS. 10–12, a merchandising display shelf track device is adapted to receive articles, especially circular pies, for sliding movement therealong. The device has a base 86, a bottom rail 88 connected to base 86 and extending longitudinally along base 86, and a tubular housing 90 connected to base 86 and positioned about bottom rail 88 so that a portion of bottom rail 88 extends longitudinally inside tubular housing 90. By tubular is meant a hollow structure which is commonly cylindrical but may be of regular or irregular cross-section. A tube may be elongated; that is, its length is greater than its diameter or cross-sectional dimension. To accommodate circular pies and pie shells, as well as other circular articles, tubular housing 90 is cylindrical with a portion of the top at the front truncated or removed to expose more of the article dispensed. The truncated opening also facilitates loading the device from the front.

A pusher mechanism 92 is connected to bottom rail 88 and slides therealong to push the articles forward in the tube for dispensing one at a time. Pies and pie shells are typically sold frozen. Upright display freezers are typically loaded from the front. Because the device is loaded from the front, a protective cover over the coil spring of the pusher mechanism is not required. A protective cover could, however, be added where rear loading is anticipated.

A front or stopper panel 94 is upstanding from base member 86 to halt forward movement of the articles thereby acting as a stopper to prevent articles from being pushed off the device. Stopper panel 94 may be flush against the front end of tube 90, but it is preferred that a space exist between stopper panel 94 and housing tube 90 to expose more of the article therein for aesthetic appeal and to make removing the article easier. Ideally, the spacing between panel 94 and housing tube 90 need not be greater than the thickness of one article.

FIG. 13 illustrates an embodiment of the invention similar to FIGS. 10–12 but replaces the base 86 and stopper panel 94 with a wire frame. The frame has bottom rails 96 and end rails 98 upstanding from bottom rails 96. A housing 100 is supported on the rails, preferably by clips integrally formed with the housing tube 100. Alternatively, a rail 102 connected to housing tube 100 and extending therebeyond may have slots or openings for engaging the wire rails of the frame. A pusher mechanism rides on housing rail 102 to push articles forward.

Referring to FIGS. 14–17, a merchandising display shelf track device is adapted to receive articles, particularly boxed articles such as pies 104, for sliding movement therealong. The device has an elongated tubular housing with top, bottom, left and right sidewalls 106, 108, 110, 112. Bottom sidewall 108 preferably has bottom extension 114 that acts as a stopper member to prevent articles from being pushed off the device.

A rail 116 is connected on the interior of the housing tube to one of the sidewalls. As illustrated, rail 116 is fastened to the top sidewall 106. A pusher mechanism 118 rides on rail 116 and pushes the articles toward the front end portion of the tubular housing. A pusher panel 120 is attached to pusher mechanism 118 to push the articles. Ideally, pusher panel 120 is about the same size in width and height as the article displayed. Preferably, pusher panel 120 is pivotable or foldable so that it can be lifted up out of the way when loading the device from the rear. A cover plate 121 can be used to cover the coil spring of the pusher mechanism when rear loading is anticipated.

Figure 14:
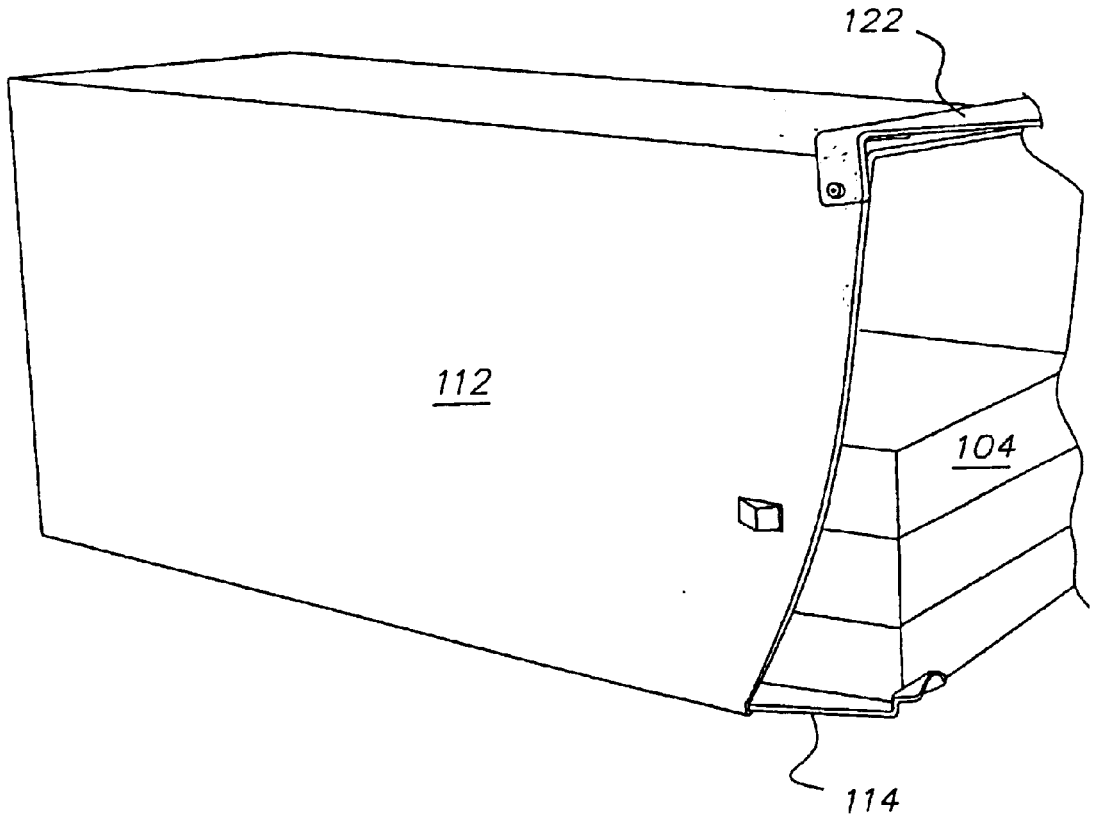
FIG. 14 is a perspective side view of another preferred embodiment of a pie pusher merchandising display track device according to the present invention.
Figure 15:
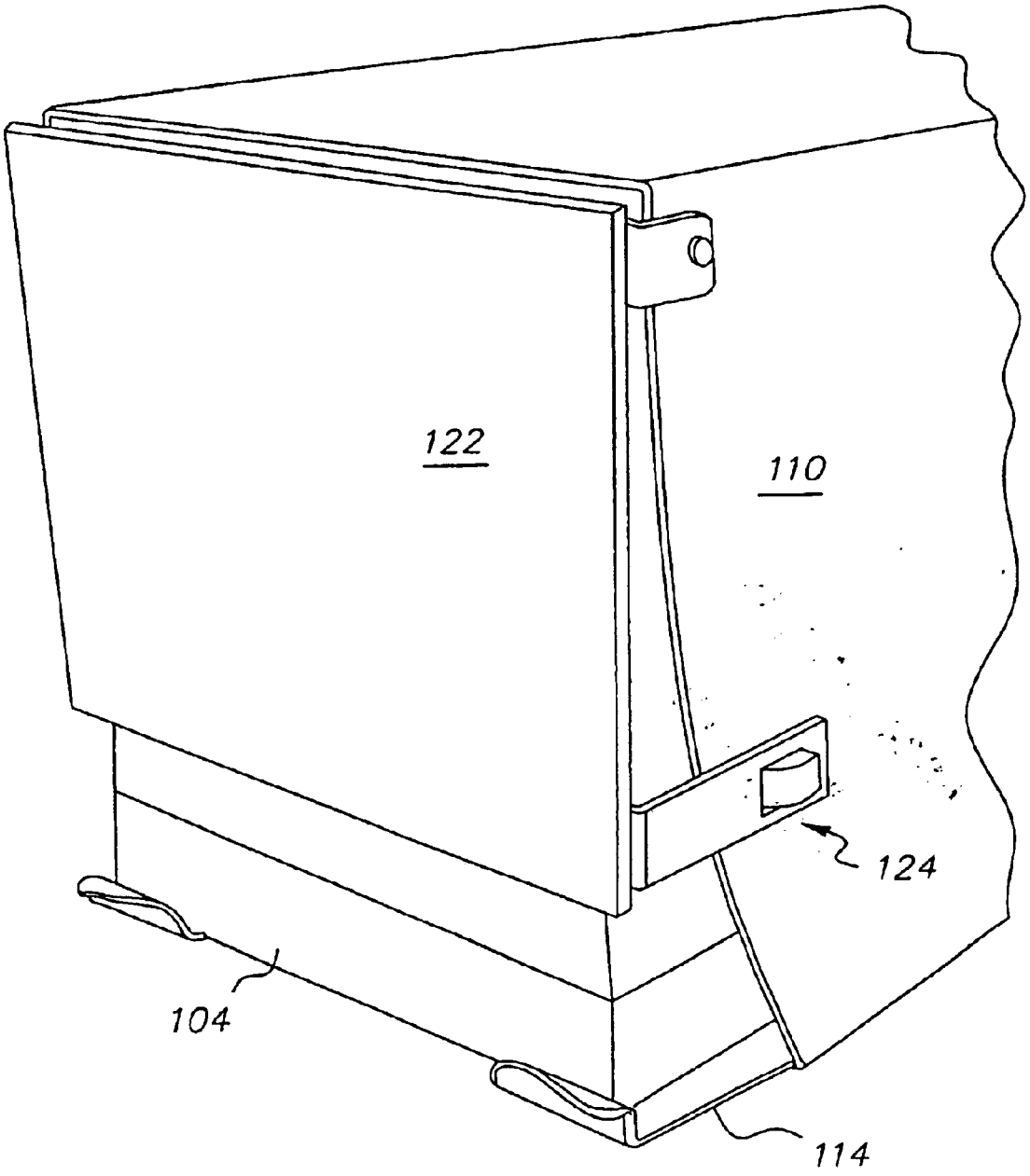
FIG. 15 is a perspective front view of the pie pusher of FIG. 14.
Figure 16:
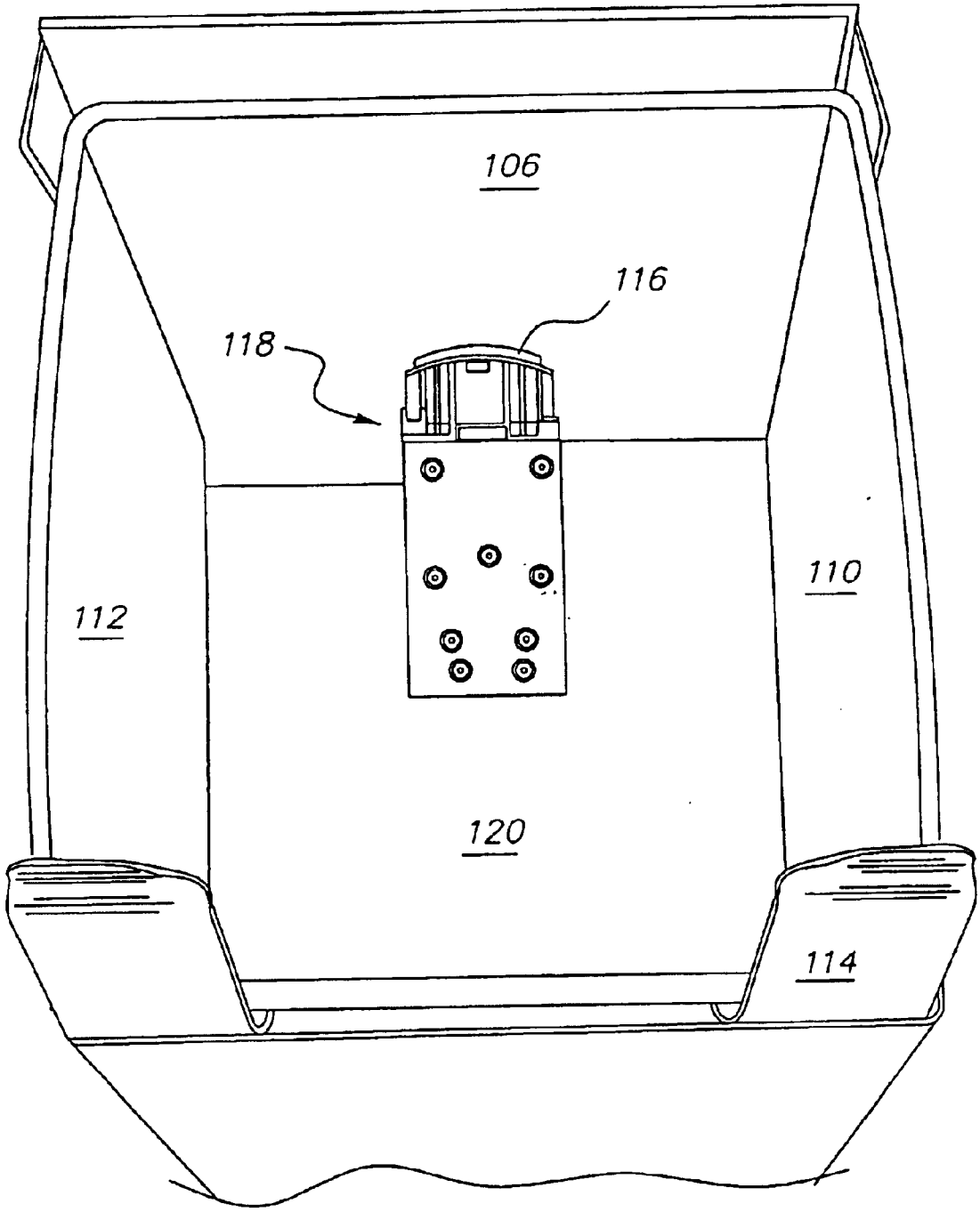
FIG. 16 is a front view of the pie pusher of FIG. 14.
Figure 17:
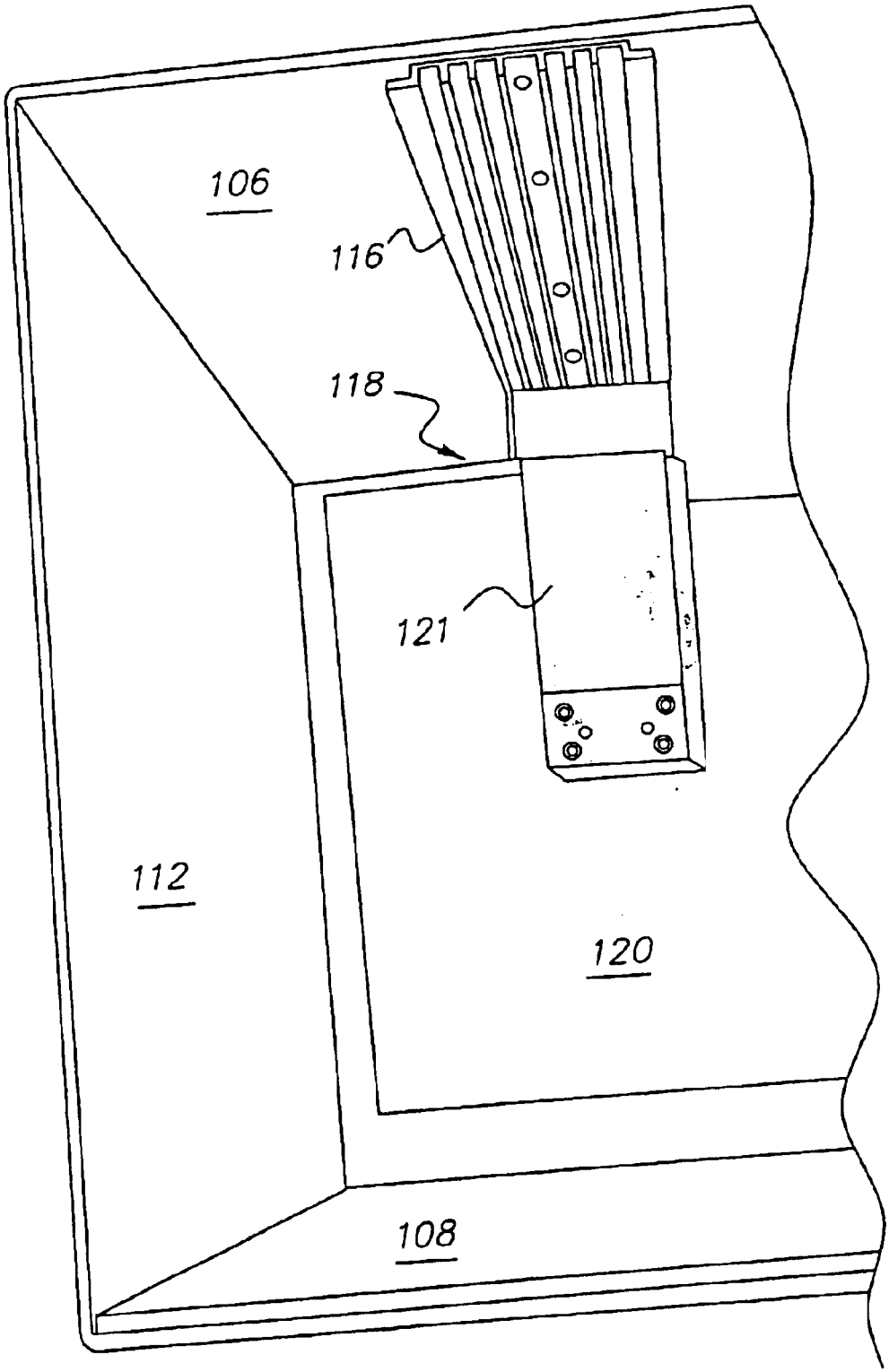
FIG. 17 is a rear view of the pie pusher of FIG. 14.

Referring to FIGS. 14–15, the articles are stacked one atop the other in columns in the device and lie in a row several columns deep. The bottom article of the frontmost column abuts bottom extension 114 which halts forward motion of the article. Articles are preferably removed from the frontmost column one at a time by removing the top article; however, when only two articles are available in the front column, the bottom article can be removed because the height of the bottom extension does not prevent removal. Removal of the bottom article requires lifting the article and simultaneously pulling the article forward. To prevent disheveling of the front column caused by trying to removed the bottom article, a door is employed.

The door has a panel 122 preferably connected to sidewalls 110, 112 of the housing with pins or other fasteners that allow pivoting motion. Panel 122 is pivotable between a closed position at which the door panel covers the front end portion of the housing to block access to the interior of the housing and an open position at which the door panel allows access to the interior of the housing through the front end portion of the housing. The door panel is vertically pivotable between the open and closed positions so that it moves up and down rather than left and right. Vertical pivotal movement ensures that the door panel does not obstruct the front column of articles so that easy removal is possible.

A latching device keeps door panel 122 in the closed position. The latching device may consist of spring fingers that abut the outside surfaces of the sidewalls and grasp the sidewalls to keep the door closed. Or, the latching device could employ magnets to keep the door closed. Or, the latching device may have a finger with an opening or keyway that engages a key or protrusion on the sidewall to keep the door closed.

It can now be appreciated that a preferred embodiment of a merchandising display shelf track device is adapted to receive articles for sliding movement therealong. The device has a base, a bottom rail connected to the base extending longitudinally along the base, and a tubular housing connected to the base and positioned about the bottom rail so that a portion of the bottom rail extends longitudinally inside the tubular housing. A pusher mechanism connected to the bottom rail pushes article forward for dispensing. A front panel attached to the front member acts as a stopper to prevent articles from being pushed off the device.

The tubular housing easily accommodates circular articles such as pies and pie shells with the articles standing on edge. A pusher mechanism connected to the bottom rail pushes the articles forward for dispensing one at a time so that a consumer does cannot rummage through articles pies to find what is thought to be the freshest article. A cover panel covers a coil spring that provides the force for pushing the articles forward. The cover panel shield fingers from the spring while restocking the articles on the shelf. The tubular housing can be equipped with a door which not only closes to keep the articles cold, but prevent inadvertent rummaging through the articles.

While the invention has been described with particular reference to the preferred embodiments, it will be understood by those skilled in the art that various changes may be made and equivalents may be substituted for elements of the preferred embodiments without departing from invention. For example, the invention has been described with reference to tubular housings and hollow parallelepiped housings, but other numbers of housing sidewalls can be used to fit the particular article. Also, the pusher mechanism is not gravity dependent and may be attached to any of the sidewalls; however, all sidewalls have a slight advantage over the bottom sidewall which is more apt to collect debris.

As is evident from the foregoing description, certain aspects of the invention are not limited to the particular details of the examples illustrated, and it is therefore contemplated that other modifications and applications will occur to those skilled in the art. For example, because the devices are only slightly larger in width and height than the articles displayed, they are candidates for stacking one atop the other as well as side by side to conserve refrigerator space. It is accordingly intended that the claims shall cover all such modifications and applications as do not depart from the true spirit and scope of the invention.

What is claimed is:

1. A merchandising display shelf track device adapted to receive articles for sliding movement therealong, comprising:

a single base member having a front end portion;

a stopper panel upstanding from said front end portion of said base member;

first and second upstanding sidewall panels connected to said base member forming a U-shaped structure having a front end portion, said front end portion of said base member extending forward more than said front end portion of said U-shaped structure;

a first spacer panel attached to said base member adjacent said first sidewall panel;

a second spacer panel attached to said base member adjacent said second sidewall panel;

a rail connected to said base member between said first and second sidewall panels and lying above said base member creating a space for air to flow between the bottoms of the articles and said base member; and a pusher mechanism adapted to ride on said rail and push the articles toward said front end portion of said U-shaped structure;

a pusher panel connected to said pusher mechanism and slidably movable along said first and second spacer panels; and a cover panel for covering a coil spring of said pusher mechanism.

2. A merchandising display shelf track device adapted to receive articles for sliding movement therealong, comprising:

a front member;

a rear member;

a bottom rail connected to said front and rear members and extending longitudinally between said front and rear members;

a first top rail connected to said front member and positioned at a higher elevation than said bottom rail, said first top rail extending longitudinally between said front and rear members;

a second top rail connected to said front member and positioned at a higher elevation than said bottom rail, said second top rail extending longitudinally between said front and rear members, said first and second rails being spaced, said top and bottom rails forming a cradle adapted to receive the articles;

a tube positioned about said top and bottom rails and extending longitudinally so that a portion of said top and bottom rails extend longitudinally inside said tube, said tube being fastened to said bottom rail; and a pusher mechanism inside said tube fastened to said bottom rail.

3. A merchandising display shelf track device, as set forth in claim 2, including a front panel attached to said front member.

4. A merchandising display shelf track device, as set forth in claim 2, including a cover panel covering a coil spring of said pusher mechanism.

5. A single merchandising display shelf track device adapted to receive articles for sliding movement therealong, comprising:

a single base member;

a front panel attached to said base member;

a bottom rail connected to said base member and extending longitudinally along said base member;

a pusher mechanism connected to said bottom rail a tubular housing connected to said base member and positioned about said bottom rail so that a portion of said bottom rail extends longitudinally inside said tubular housing; and a cover panel covering a coil spring of said pusher mechanism.

6. A merchandising display shelf track device adapted to receive articles for sliding movement therealong, comprising:

an elongated tubular housing having an interior sidewall and a front end portion;

a rail connected to said interior sidewall;

a pusher mechanism adapted to ride on said rail and push the articles toward said front end portion of said tubular housing; and a door panel connected to said housing and pivotable between a closed position at which said door panel covers said front end portion to block access to said interior of said housing and an open position at which said door panel allows access to said interior through said front end portion, said door panel being vertically pivotable between the open and closed positions.

7. A merchandising display shelf track device, as set forth in claim 6, wherein said tubular housing has four interior sidewalls and said rail is connected to one of said sidewalls.

8. A merchandising display shelf track device, as set forth in claim 6, wherein said front end portion of said tubular housing has a bottom extension.

* * * * *